US006809686B2

(12) United States Patent
Du et al.

(10) Patent No.: US 6,809,686 B2
(45) Date of Patent: Oct. 26, 2004

(54) MULTI-BAND ANTENNA

(75) Inventors: Xin Du, Bartlett, IL (US); Francisco X. Gomez, Melrose Park, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/172,960

(22) Filed: Jun. 17, 2002

(65) Prior Publication Data

US 2003/0231137 A1 Dec. 18, 2003

(51) Int. Cl.[7] ..... H01Q 1/38
(52) U.S. Cl. ..... 343/700 MS; 343/846
(58) Field of Search ..... 343/700 MS, 872, 343/873, 769, 846

(56) References Cited

U.S. PATENT DOCUMENTS 4,554,549 A * 11/1985 Fassett et al. ..... 343/700 MS
5,055,852 A * 10/1991 Dusseux et al. ..... 343/769

* cited by examiner

*Primary Examiner*—Michael C. Wimer
(74) *Attorney, Agent, or Firm*—Babcock IP, LLC

(57) ABSTRACT

A multi-band antenna with a radiator element located between a ring element with a feed leg and at least one ground leg, and a ground plane. The radiator element may be arranged in a substantially parallel orientation with and electrically isolated from the ring element and the ground plane. The antenna elements may be dimensioned for reception of AMPS, UMTS, PCS and SDAR frequency bands. Further, the antenna may include a GPS module.

50 Claims, 8 Drawing Sheets

MULTI-BAND ANTENNA

BACKGROUND OF THE INVENTION

1. Field of the Invention

The invention relates to multi-band antennas. More specifically, the invention relates to a multi-band antenna having a low profile, for example, suitable for mounting on a motor vehicle.

2. Description of Related Art

Modern vehicles may have several different radio receivers and or transmitters operating in different frequency bands. Previously, each band required its own separate antenna structure, or dual band antennas where available for two or three bands, for example the AMPS, UMTS and PCS cellular telephone frequency bands. Multiple bands may be serviced by discrete antenna structure, arranged in a common antenna housing to reduce costs by requiring only a single protective antenna enclosure and vehicle mounting point/hole for routing cabling for interconnection with the vehicle wire harness leading to the different receivers/transmitters.

Satellite Digital Audio Radio (SDAR) is a form of digital satellite radio, currently offered on a subscription basis by XM™ and Sirius™. SDAR receives in the S-Band frequency range (2.3 Gigahertz Band) requiring upper hemisphere coverage. To provide reception in urban environments where satellite line of sight signals may be blocked by earth contours, buildings and/or vegetation SDAR uses both satellite and terrestrial mounted transmitters and therefore requires antennas with vertical radiation patterns (satellite) as well as improved low angle performance (terrestrial). XM™ specifies antenna performance of 2 dBic over a range of 25–60 degrees elevation. Sirius™ specifies antenna performance of 3 dBic over 25–75 degrees elevation and 2 dBic over 75–90 degrees elevation.

Growth of SDAR, and GPS adds a potential requirement for two or more additional antennas. Rather than mounting several discrete antennas on a vehicle, vehicle manufacturers and consumers prefer multi-band antenna assembles with a minimized vertical profile. Low profile antennas increase resistance to accidental breakage from, for example, automated car washes and tree limbs. Less visually noticeable from a distance, low profile antennas also reduce vandalism and theft opportunities. Also, negative effects on aerodynamics and disruption of vehicle design aesthetics are minimized.

Competition within the antenna industry has focused attention on minimization of antenna materials and manufacturing costs.

Prior SDAR antennas have used a left hand circularly polarized quadrifilar antenna element configuration. Another antenna element configuration used with SDAR is the curved cross dipole configuration. Both types of antenna structures have antenna element vertical heights of at least one inch.

Circular microstrip antennas have a fundamental TM11 excitation mode with a narrow beam. Circular microstrip antennas have been used for satellite reception where an upper hemisphere radiation pattern with poor low angle coverage is acceptable, for example with Global Positioning Satellites (GPS). Circular microstrip antenna designs are inexpensive, durable and have an extremely low profile. Microstrip antennas may be configured to operate in a TM21 higher order mode that creates a conical radiation pattern with a null at center/vertical, useful for receiving low angle terrestrial originated signals.

Hula-Loop (directional-discontinuity ring-radiator) antennas comprising a looped conductor with a feed and a ground leg are a known solution for low profile antennas for AMPS and GSM cellular radio frequencies. However, this antenna configuration has previously been usable only for a single band and the resulting ring form had a large diameter compared to other known AMPS/GSM band antenna configurations, for example low profile monopoles.

Therefore, it is an object of the invention to provide an antenna, which overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

During development of an SDAR circular radiator element microstrip antenna using a parasitic ring to improve low angle frequency response it was discovered that the resulting parasitic ring configuration had similar dimensions to a ½ wavelength hula-loop configuration known to be usable with cellular bands. Further experimentation revealed that the higher mixed mode effect of the parasitic ring may be maintained even though consideration is also given to configuration of the parasitic ring as a hula-loop antenna for cellular bands. Use of a tuned feed leg of the parasitic ring creates acceptable UMTS, PCS and SDAR terrestrial bands frequency response in the hula-loop element. At least one ground leg of the hula-loop element may be optionally coupled to a ¼ wavelength co-axial stub for improvement of AMPS band frequency response. The hula-loop and radiatorr element structures together create a low profile, cost effective multi-band antenna assembly sharing a common ground plane.

Figure 1A:
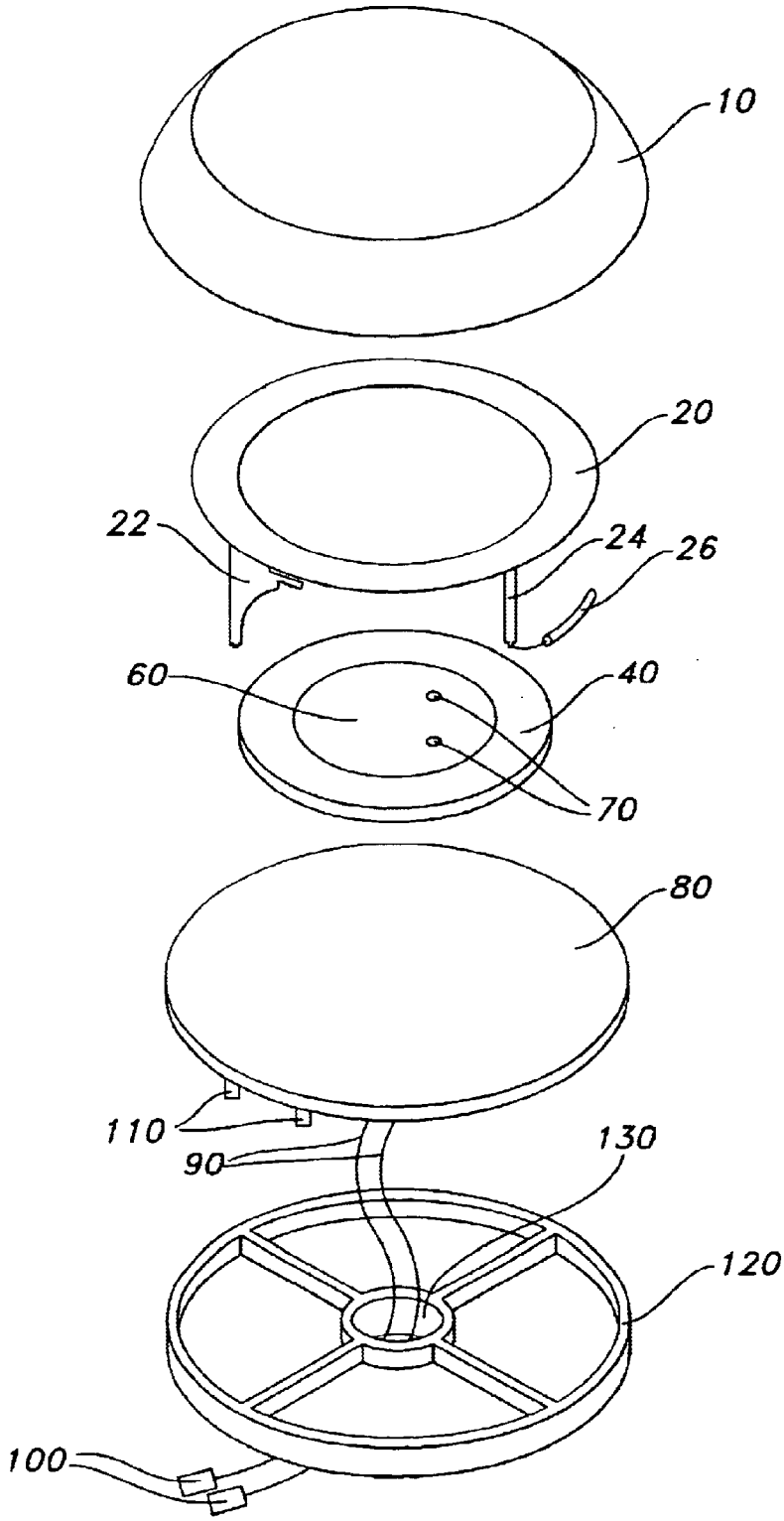
FIG. 1*a* shows an exploded isometric view of a first embodiment of the invention.
Figure 1B:
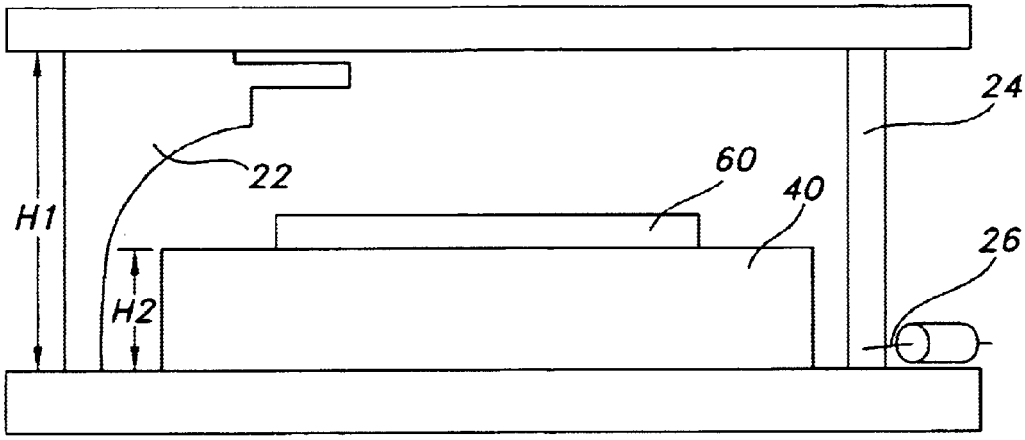
Fig. 1*b* shows a side view of antenna elements of a first embodiment of the invention.
Figure 1C:
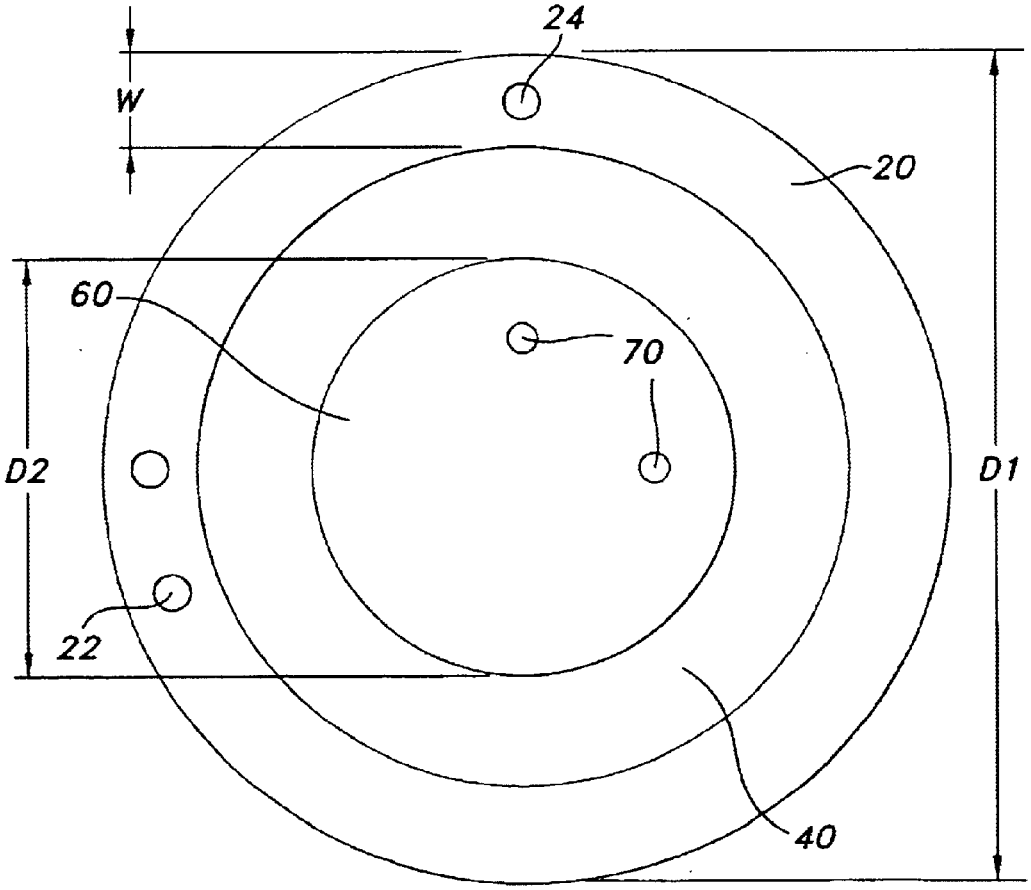
FIG. 1*c* shows a top view of antenna elements of a first embodiment of the invention.

A first embodiment of the antenna is shown in FIGS. 1*a*–1*c*. The antenna has a cover 10 that mates to a base plate 120. The base plate 120 may be metal or metal alloy, formed for example, by die casting. The cover 10 may be formed, for example by injection molding using a RF transmissive insulating material, such as polycarbonate, acrylic or other plastic material. The cover 10 may be formed to create an environmental seal against the base plate 120, isolating the antenna elements and circuitry from water and other contaminant infiltration. Application of a sealing adhesive and/or a gasket (not shown) may aid the environmental seal.

A printed circuit board (PCB) 80 which may contain electrical components 110 on its underside, e.g., at least one low noise antenna preamplifier and/or tuning/filter circuitry has a ground plane conductive layer which mates with contact points of the base plate 120 creating a common ground plane for the antenna which extends through the base plate 120 to a vehicle body upon which the antenna may be mountable. Coaxial antenna leads 90 for the different signal bands attached to the PCB 80 are routed through a hole 130 in the base plate 120 for connection to a vehicle receiver(s) antenna inputs wire harness via coaxial connectors 100.

An insulator 40 may be located on a top side of the PCB 80. Suitable materials for insulator 40 may include, for example, polystyrene, polyphenolic oxide or other low cost materials, for example with a suitable dielectric constant in the range of about 2–10. As shown in FIG. 1*b,* the insulator 40 has a height H2, of at least 3 millimeters, for example 3.175 millimeters. A, for example, circularly shaped radiator element 60, having a diameter D2 (FIG. 1*c*) of about 38 millimeters, attached to the insulator 40, receives SDAR-satellite signals. The radiator element 60 has two feeds 70 through the insulator 40 coupled to the PCB 80. The feeds 70 may be physically arranged at 90 degrees to each other with respect to a center of the radiator element 60. In an alternative embodiment, the feeds 70 may be increased to four connections arranged orthogonally, that is at 90 degrees to each other, with respect to a center of the radiator element 60. Increasing the number of feeds 70 to four increases the uniformity of the antenna response pattern by minimizing pattern tilt but causes a slight increase in manufacturing costs.

Figure 4A:
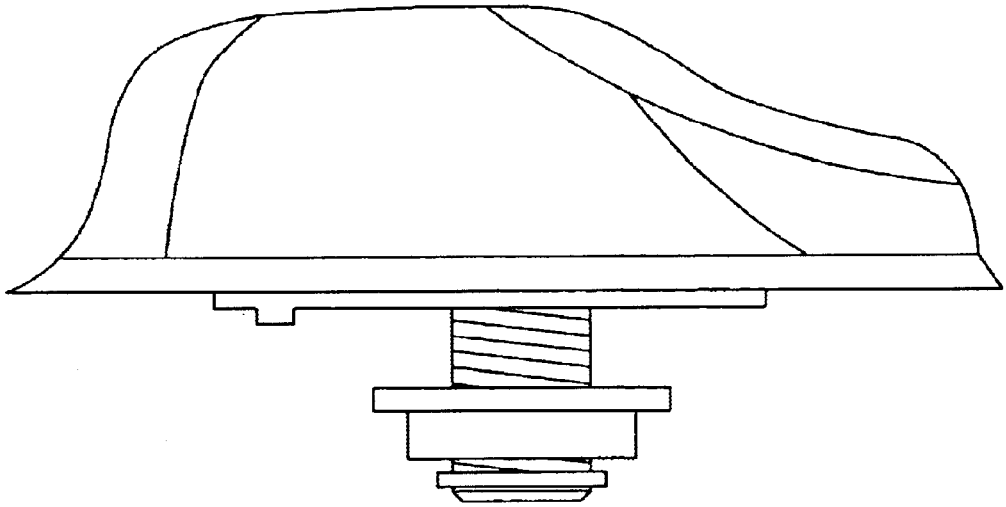
FIG. 4*a* shows an external top view of the embodiment of FIG. 2*a*.
Figure 4B:
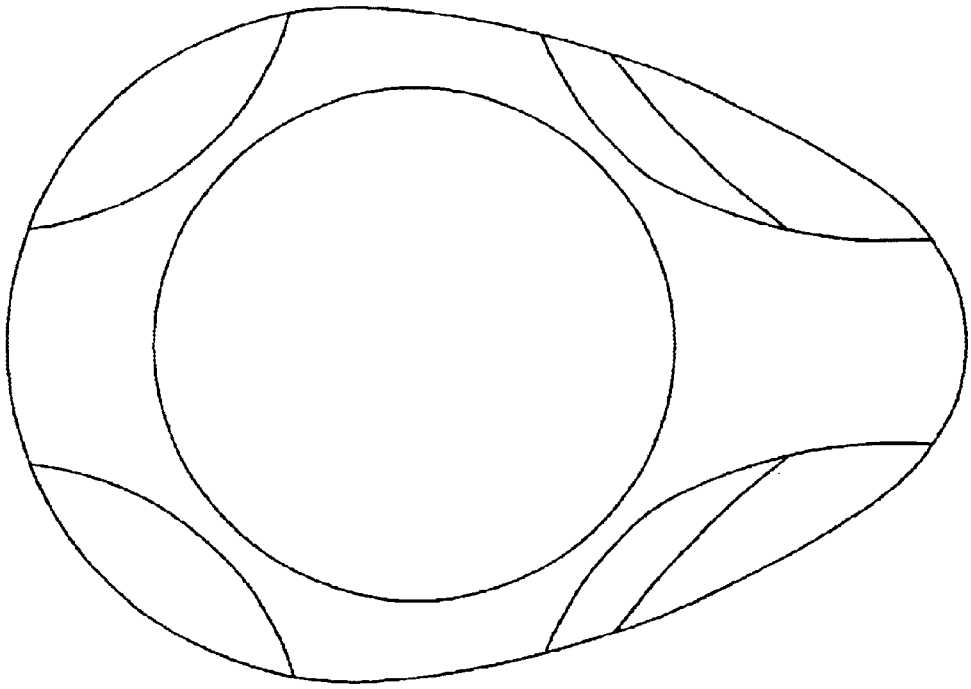
FIG. 4*b* shows an external side view of the embodiment of FIG. 2*a*.

AMPS, UMIS, PCS and SDAR-terrestrial signals are received by a,for example, circular ring element 20 spaced above or below, generally parallel and concentric with the radiator element 60 at a height H1 (FIG. 1*b*) of approximately 1/15 wavelength, for example, 26.7 millimeters above the PCB 80 by a feed leg 22 and a ground leg 24. Alternatively, as shown in FIG. 4*b,* the ring element may be formed as a ring conductive layer 21 on a substrate. In this embodiment the width of the ring conductive layer 21 may be easily modified, allowing a ring element (ring conductive layer 21) width parameter to be used in tuning of the antenna dimensions for best frequency response.

The feed leg 22 may be shaped, for example by tapering, notching or other configuring to create multiple RF paths to the ring element 20 in order to tune the frequency response of the ring element 20,21. By refining the shape of the feed leg 22, acceptable frequency responses for the AMPS, UMTS, PCS and SDAR-terrestrial bands may be created.

Ground leg 24 may be directly attached to the PCB 80 or coupled with the conductor of a ¼ wavelength stub 26 that has a length approximately equal to a ¼ wavelength length of a center frequency of the AMPS frequency band. A shield of the ¼ wavelength stub may be coupled with the ground plane of PCB 80. Alternatively, the stub 26 may be formed as an isolated ¼ wavelength long conductive layer 27 upon the PCB 80.

The feed leg 22 and ground leg 24 may be, attached to the ring element 20 at connection points spaced along the ring element 20, for example, at 110 degrees to each other with respect to a center of the ring element 20. As shown in FIG. 4*a,* an additional ground leg 25, which may be directly coupled with the ground plane of the PCB 80, may be used at a location, for example, between 90 and 110 degrees to increase possible RF current paths, thereby improving AMPS frequency response.

Figure 2:
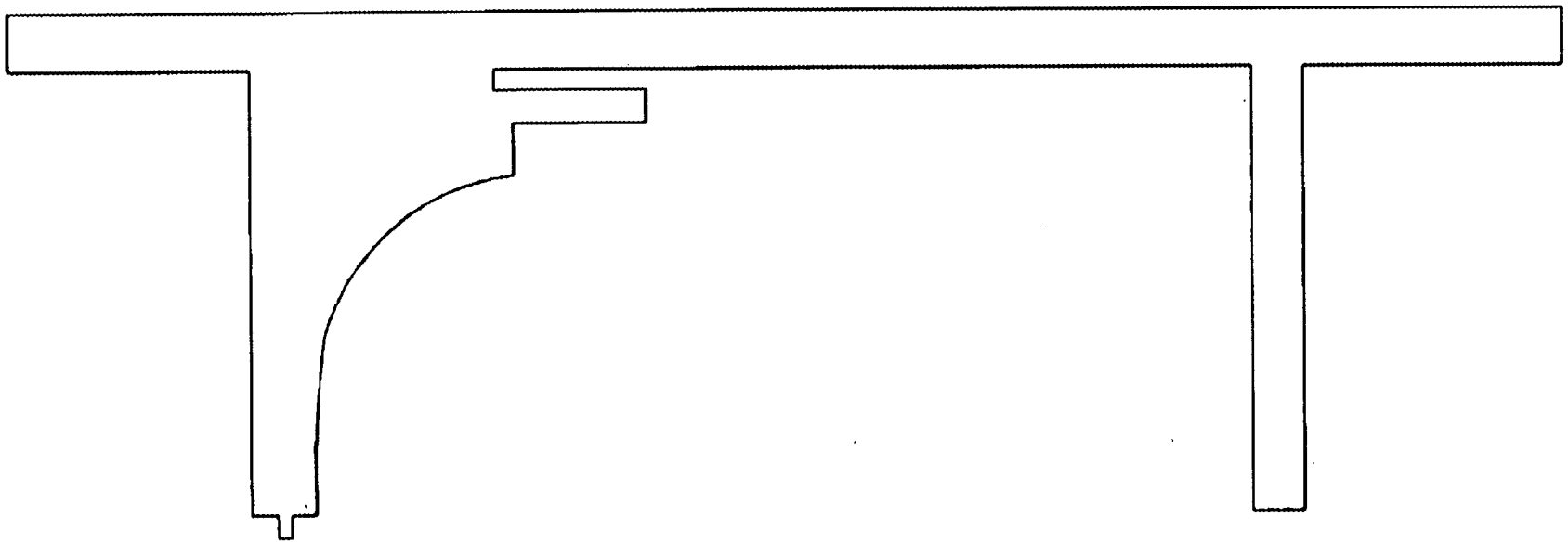
FIG. 2 shows a side view of a ring element blank.

As shown in FIG. 2, to improve manufacturing efficiency and ensure repeatability of the ring element 20, feed leg 22 and ground leg(s) 24 dimensions, the ring element 20, feed leg 22 and ground leg(s) 24 may be formed from a single stamped or cut form from a conductive sheet which may then connected to itself at the ends to create the loop shape.

Variations of the first embodiment include dimensional changes of the elements and their positions with respect to each other. For example, if the ring element 20 width is modifiable, a width W of the ring element 20 may be narrowed if the ring element 20 diameter D1 is increased (see FIG. 1*c*). Alternatively, the antenna dimensions may be designed for different target frequency bands. The antenna element dimensions and spacing being appropriately adjusted to match the midpoint frequencies of the chosen target frequency bands for the best overall performance.

Figure 3A:
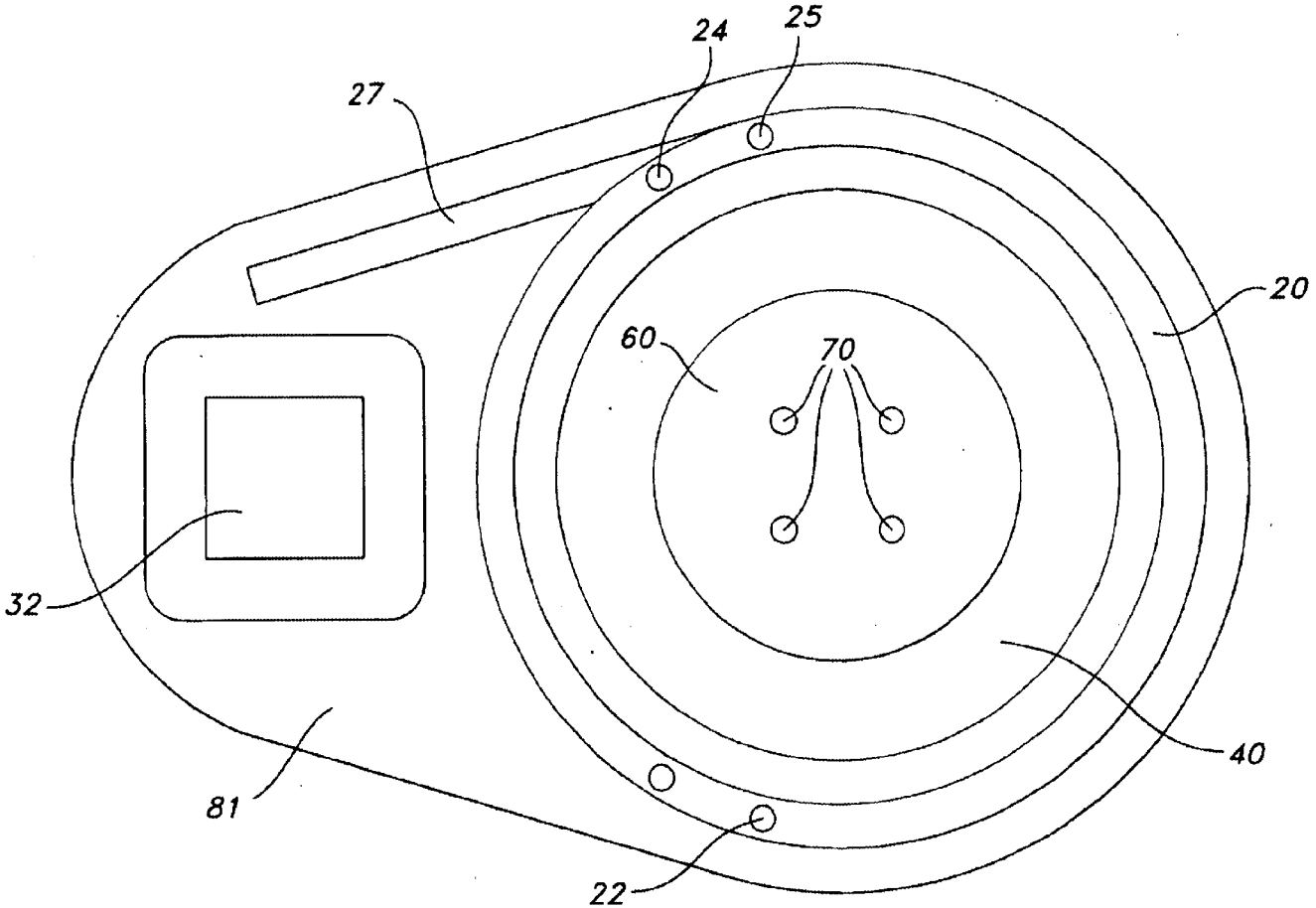
FIG. 3*a* shows a top view of a second embodiment of the invention.
Figure 3B:
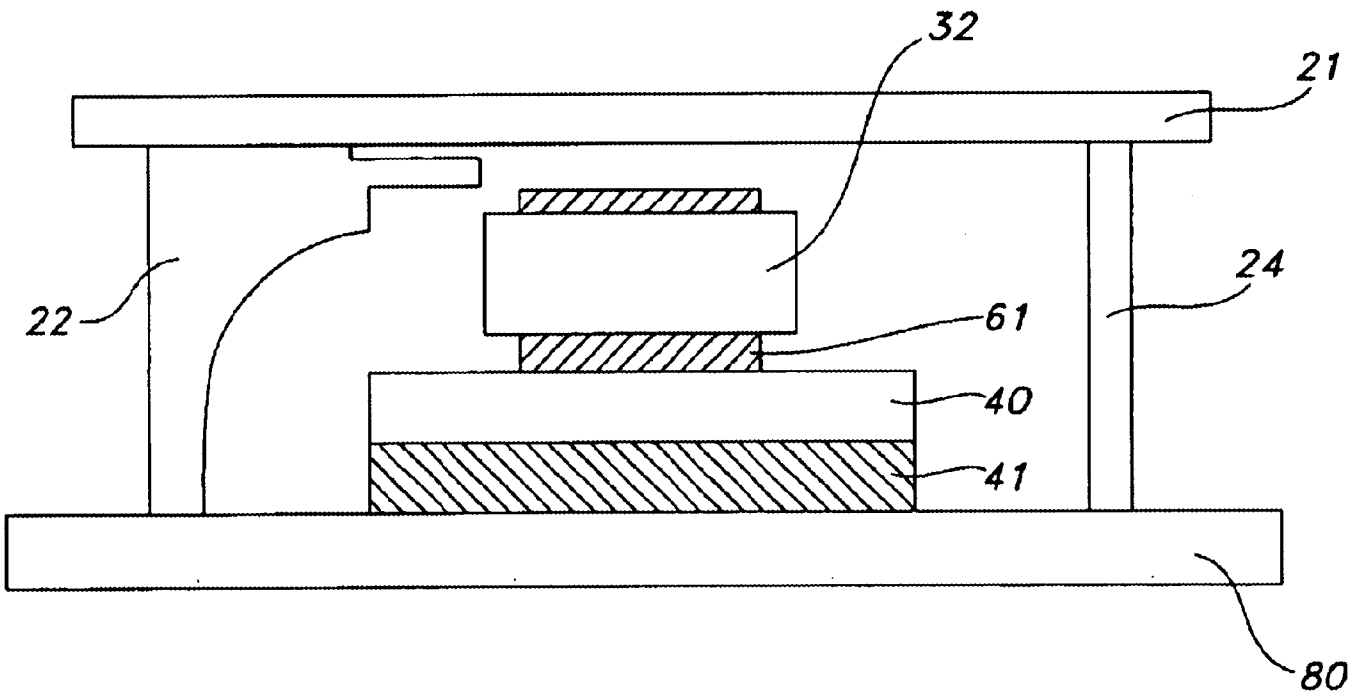
FIG. 3*b* shows a side view of a third embodiment of the invention.

In a second and a third embodiment as shown in FIGS. 3*a* and 3*b,* GPS capability may be added by the addition of a separate GPS antenna assembly 32. GPS antenna modules are readily available as a sub-assembly that has been optimized for performance and cost. Using a separate GPS antenna assembly 32 causes only a minor increase in overall antenna assembly size and the design and manufacture of the antenna circuitry on PCB 80 or 81 and the connections of the different coaxial antenna leads 90 is greatly simplified.

In FIG. 3*a,* the GPS module may be mounted on an extended portion of the PCB 80, alongside the other antenna elements. In this embodiment, the overall size of the antenna is increased but integration and added manufacturing assembly costs are minimized.

In FIG. 3*b,* the GPS module may be mounted on top of the radiating element 61, similar to the radiating element 60 in FIG. 1*a*. In this embodiment, size of the antenna is conserved but manufacturing costs rise because of the difficulty of routing the GPS connection through the existing components. Examples of possible external side and top views of this embodiment are shown in FIGS. 4*a* and 4*b*.

Normally, the height H1 (FIG. 1*b*) may be selected to be less than one quarter of the wavelength of the target frequency. The height H1, in combination with the ring element width W and outer diameter D1 dimensions are selected to create a level of higher mode excitation and thereby tune the resulting beam width. In order to preserve the tuned dimensions of the tapered feed leg 22, if the height H1 needs to be modified, a conductive spacer 41 (FIG. 3*b*) may be used to raise the effective height of the ground plane of PCB 81, with respect to the radiator element 61.

The initial dimensions of the antenna elements may be calculated using cavity model calculations even though the height H1 exceeds the generally accepted valid range for the cavity model. Further adaptation may be made by using commercial structure simulation software using method of moment functionality, for example IE3D by Zeland Inc. of Fremont, Calif., USA.

Figure 5A:
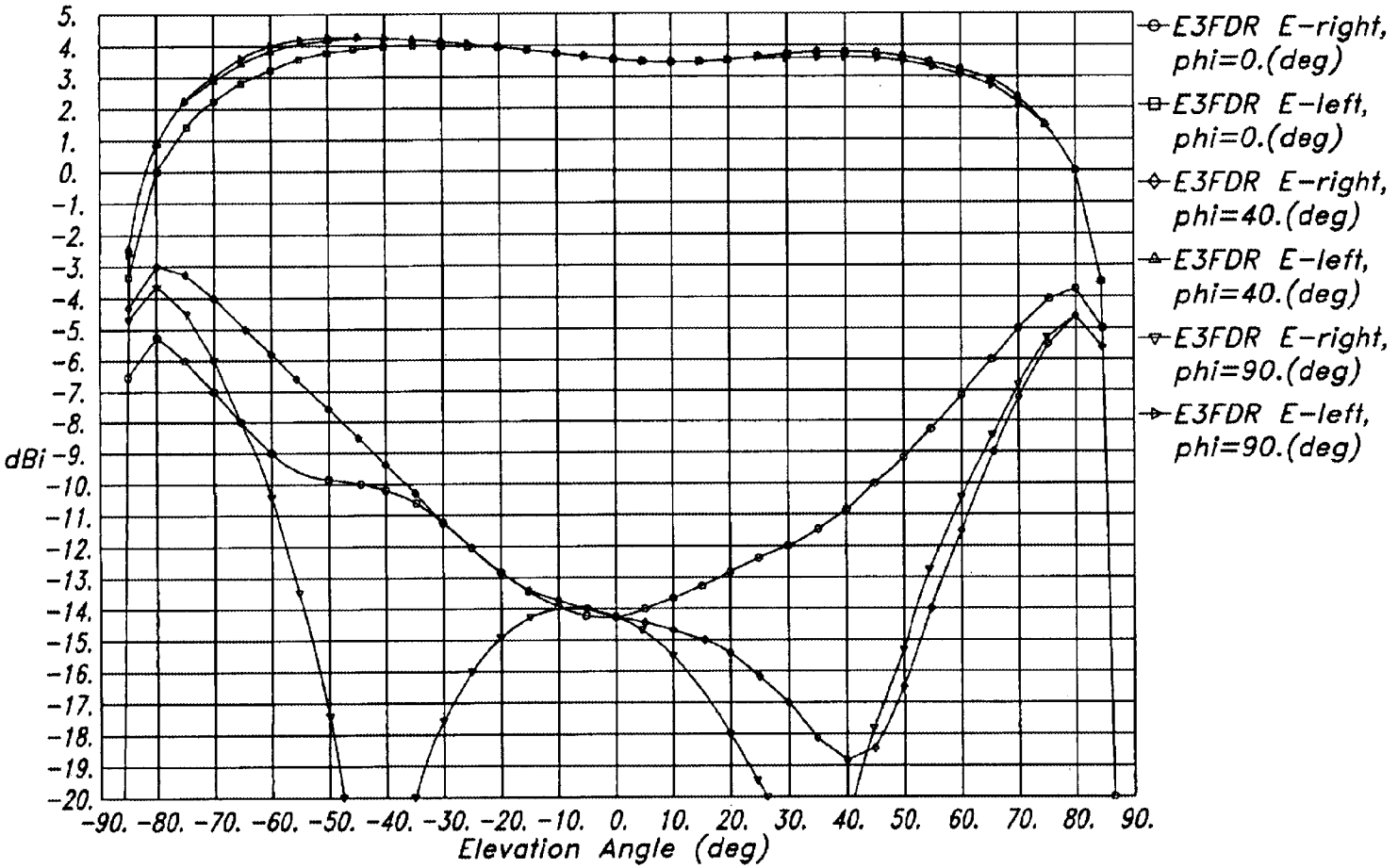
FIG. 5*a* shows elevation angle test performance data of the first embodiment.

As demonstrated by the dBi/elevation angle test data shown in FIG. 5*a,* the ring element 20 has a beneficial effect on the reception field of the radiator element 60. Acting as a parasitic element, the ring element 20 disturbs the field received by the conductor 60 to a different resonant level (perturbation), creating a mixed (higher) mode. As a result, the previously poor low angle coverage of a TM11 mode radiator element 60 may be improved to a level that satisfies SDAR antenna requirements.

Figure 5B:
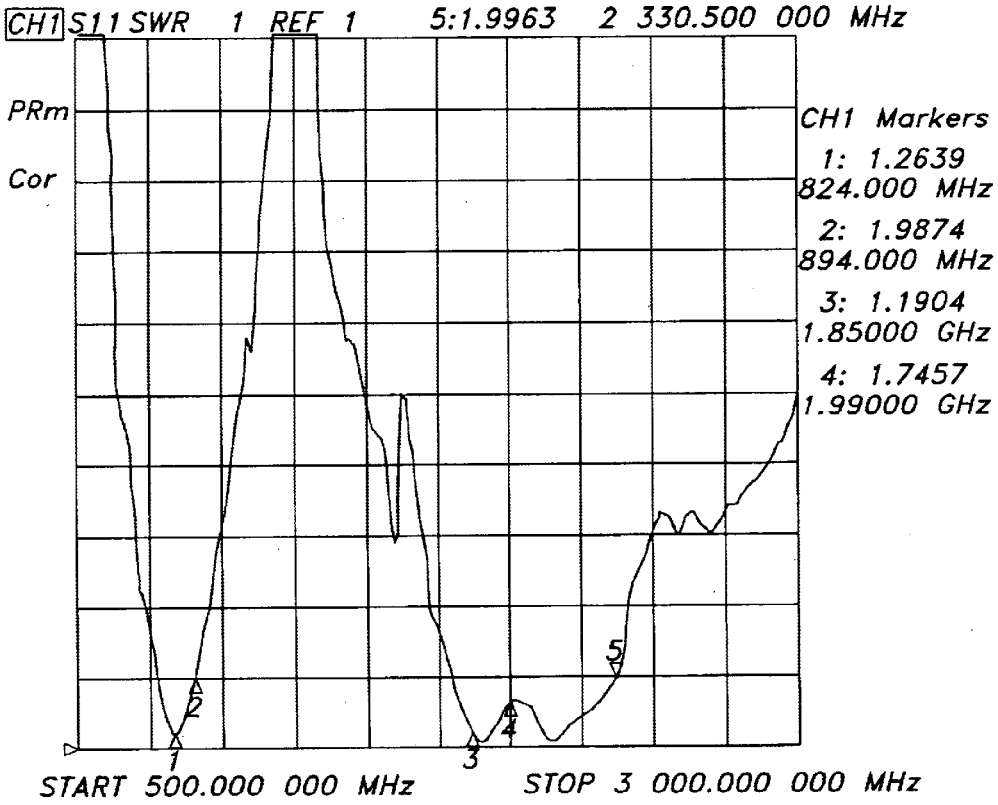
FIG. 5*b* shows multiple frequency SWR test performance data of the first embodiment.

As demonstrated by the wide band standing wave ratio (SWR) test data of the first embodiment, shown in FIG. 5*b*, the antenna may be dimensioned so that the SWR at the AMPS, UMTS, PCS and SDAR frequencies is less than 2.

As described, the multi-band hula-loop antenna provides the following advantages. The antenna provides coverage of AMPS, UMTS, PCS, SDAR and GPS bands in a single cost-effective compact low-profile assembly, for example having a diameter which may be approximately 4 inches or less and a height which may be approximately 1 inch or less. Use of printed circuit technology decreases component costs and increases final manufacturing assembly efficiency.

Table of Parts

10 cover
20 ring
21 ring conductive layer
22 feed leg
24 ground leg
25 additional ground leg
26 ¼ wavelength stub
27 ¼ wavelength conductive layer
32 GPS module
40 insulator
41 conductive riser
60 radiator element
71 radiator element
70 feed
80 printed circuit board
81 printed circuit board
90 antenna lead
100 connector
110 electrical component
120 base plate
130 hole Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention if the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A multi-band antenna, comprising:

a radiator element located between a ring element with a feed leg and at least one ground leg, and a ground plane;

the radiator element arranged in a substantially parallel orientation with and electrically isolated from the ring element and the ground plane; and the ground leg is attached to a ¼ wavelength stub.

2. The antenna of claim 1, further comprising an insulator, located between the radiator element and the ground plane.

3. The antenna of claim 2, wherein the insulator has a thickness of at least 3 millimeters.

4. The antenna of claim 1, further comprising a cover with an open end, mated to the ground plane, enclosing the ring element, and the radiator element.

5. The antenna of claim 1, further comprising a base plate coupled to the ground plane;

a cover mating to the base plate, the cover enclosing the ring element, and the radiator element.

6. The antenna of claim 1, wherein the feed leg is shaped to tune the ring element frequency response to at least one target frequency.

7. The antenna of claim 1, wherein the ground plane is a conductive layer on a printed circuit board.

8. The antenna of claim 7, further comprising at least two amplifier circuits located on the printed circuit board.

9. The antenna of claim 1, wherein the radiator element has two feed points arranged in a substantially 90 degrees orientation with respect to a center point of the radiator element.

10. The antenna of claim 1, wherein the radiator element has four teed points arranged in a substantially orthogonal orientation from a center point of the radiator element.

11. The antenna of claim 1, wherein the ¼ wavelength stub is a conductor with a shield, the shield coupled to the ground plane.

12. The antenna of claim 1, wherein the ground plane is a printed circuit board, and the ¼ wavelength stub is an isolated trace on the printed circuit board.

13. The antenna of claim 1, wherein the at least one ground leg and the teed leg are attached to the ring element at an angle of about 110 degrees with respect to a center of the ring element.

14. The antenna of claim 1, wherein the ring element is a length of metallic wire with interconnected ends.

15. The antenna of claim 1, wherein the ring element is a metallic trace on an insulator substrate.

16. The antenna of claim 1, wherein the ring element has an outer diameter of about ½ wavelength.

17. The antenna of claim 1, wherein the ring element is arranged about 1/15 wavelength above the ground plane.

18. The antenna of claim 1, wherein the radiator element is located at least 3 millimeters above the ground plane.

19. The antenna of claim 1, wherein the radiator element has a circular shape.

20. The antenna of claim 1, further comprising a conductive riser located between the insulator and the ground plane.

21. The antenna of claim 1, wherein the ring element, radiator element are dimensioned and the spacing of the ring element, radiator element with respect to the ground plane is selected for reception of AMPS, PCS and SDAR frequency bands.

22. The antenna of claim 1, wherein a diameter, a width and a height dimension of the ring element are selected to create a higher order mode in the ring element with respect to the radiator element.

23. The antenna of claim 1, wherein AMPS, UMTS, PCS and SOAR frequency bands are receivable with a standing wave ratio of 2 or less.

24. A multi-band antenna, comprising:

a radiator element located between a ring element with a feed leg and at least one ground leg, and a ground plane;

the radiator element arranged in a substantially parallel orientation with and electrically isolated from the ring element and the ground plane;

the ring element, feed leg and at least one ground leg formed from a conductive sheet.

25. A multi-band antenna, comprising:

a radiator element located between a ring element with a feed leg, two ground legs and a ground plane;

the radiator element arranged in a substantially parallel orientation with and electrically isolated from the ring element and the ground plane.

26. A multi-band antenna, comprising:

a radiator element located between a ring element with a feed leg and at least one ground leg, and a ground plane;

the radiator element arranged in a substantially parallel orientation with and electrically isolated from the ring element and the ground plane; and a GPS module.

27. The antenna of claim 26, wherein the GPS module is located on a top surface of the radiator element.

28. The antenna of claim 26, wherein the GPS module is located on a top surface of the printed circuit board.

29. A multi-band antenna, comprising a cover;

a ring element with a feed leg and at least one ground leg;

the ring element arranged in a substantially parallel orientation spaced one of above and below, and electrically isolated from a first side of a radiator element;

a second side of the radiator element abutting an insulator;

the insulator abutting a printed circuit board having a ground plane conductive layer and a first low noise amplifier circuit and a second low noise amplifier circuit;

the printed circuit board abutting a base plate;

the ring element coupled with the first low noise amplifier circuit;

the radiator element coupled with the second low noise amplifier circuit;

the cover mating with the base plate, enclosing the ring element, the radiator element, the insulator and the printed circuit board.

30. The antenna of claim 29, wherein the insulator has a thickness of at least 3 millimeters.

31. The antenna of claim 29, wherein the feed leg is shaped to tune a ring element frequency response to at least one target frequency.

32. The antenna of claim 29, wherein the ring element has a circular shape.

33. The antenna of claim 29, wherein the ring element is formed from a conductor having a circular cross section.

34. The antenna of claim 29, wherein the ring element is a conductive layer on a substrate.

35. The antenna of claim 29, wherein the ring element has a diameter of about ½ wavelength.

36. The antenna of claim 29, wherein the ring element is located about 1/15 wavelength above the ground plane.

37. The antenna of claim 29, wherein the ring element is circular shaped and the radiator element is circular shaped; and the ring element is located concentric with the radiator element.

38. The antenna of claim 29, wherein an input to the first low noise amplifier is coupled to a 90 degrees hybrid coupler coupled to a pair of feeds attached to the radiator element at 90 degrees to each other with respect to a center of the radiator element.

39. The antenna of claim 29, wherein an input to the first low noise amplifier is coupled to a 90 degrees hybrid coupler coupled to a four feeds attached to the radiator element at 90 degrees to each other with respect to a center of the radiator element.

40. The antenna of claim 29, further comprising a first shielded conductor, coupled with a first low noise amplifier output of the first low noise amplifier; and a second shielded conductor, coupled with a second low noise amplifier output of the second low noise amplifier;

the first shielded conductor and the second shielded conductor routed through an aperture in the base plate.

41. The antenna of claim 29, further comprising a conductive riser, located between the insulator and the ground plane conductive layer.

42. The antenna of claim 29, further comprising a GPS module.

43. The antenna of claim 42, wherein the GPS module is located on a top surface of the radiator element.

44. The antenna of claim 43, wherein the GPS module is located on a top surface of the printed circuit board.

45. The antenna of claim 29, wherein a diameter, a width and a height dimension of the ring element are selected to create a higher order mode in the ring element with respect to the radiator element.

46. The antenna of claim 29, wherein AMPS, PCS and SDAR frequency bands are receivable with a standing wave ratio of 2 or less.

47. A multi-band antenna comprising:

a ring element with a feed leg shaped to tune a ring element frequency response to at least one target frequency; and at least one ground leg coupled to a ¼ wavelength stub;

the ring element arranged in a substantially parallel orientation spaced one of above and below, and electrically isolated from a printed circuit board;

the printed circuit board having a ground plane formed from a conductive layer on the printed circuit board.

48. The antenna of claim 47, wherein the antenna is configured for reception of AMPS, PCS and SDAR-Terrestrial frequency bands.

49. The antenna of claim 47, further comprising a second feed leg coupled to the ground plane.

50. A multi-band antenna having arranged in mutually spaced, generally parallel relationship, in the following order:

a ground plane;

a radiator adapted to receive a first signal and configured to receive and transmit a first range of frequencies; and a parasitic ring configured to modify a beam pattern produced by said radiator, said ring being adapted to receive a second signal and to serve also as a radiator for a second range of frequencies different from said first range of frequencies;

the parasitic ring fed through a tuned feed structure; the tuned feed structure tuned by notching, tapering or otherwise shaping the feed structure.

* * * * *